US009115575B2

(12) United States Patent
MacAdam et al.

(10) Patent No.: US 9,115,575 B2
(45) Date of Patent: Aug. 25, 2015

(54) INDIRECT DOWNHOLE STEAM GENERATOR WITH CARBON DIOXIDE CAPTURE

(75) Inventors: Scott MacAdam, Calgary (CA); James P. Seaba, Bartlesville, OK (US)

(73) Assignee: ConocoPhillips Company, Houston, TX (US)

( * ) Notice: Subject to any disclaimer, the term of this patent is extended or adjusted under 35 U.S.C. 154(b) by 483 days.

(21) Appl. No.: 13/597,512

(22) Filed: Aug. 29, 2012

(65) Prior Publication Data

US 2013/0062065 A1 Mar. 14, 2013

Related U.S. Application Data

(60) Provisional application No. 61/533,849, filed on Sep. 13, 2011.

(51) Int. Cl.
*E21B 43/24* (2006.01)
*E21B 36/02* (2006.01)

(52) U.S. Cl.
CPC ..... *E21B 43/24* (2013.01); *E21B 36/02* (2013.01)

(58) Field of Classification Search
CPC ..... E21B 36/02; E21B 43/24; E21B 43/241
See application file for complete search history.

(56) References Cited

U.S. PATENT DOCUMENTS

| | | | | |
|---|---|---|---|---|
| 4,243,098 | A | 1/1981 | Meeks et al. | |
| 4,336,839 | A | 6/1982 | Wagner et al. | |
| 4,385,661 | A | 5/1983 | Fox | |
| 4,390,062 | A | 6/1983 | Fox | |
| 7,077,198 | B2 * | 7/2006 | Vinegar et al. | 166/245 |
| 7,980,312 | B1 | 7/2011 | Hill et al. | |
| 2006/0231455 | A1 | 10/2006 | Olsvik et al. | |
| 2008/0173584 | A1 | 7/2008 | White et al. | |
| 2008/0173585 | A1 | 7/2008 | White et al. | |
| 2009/0236092 | A1 | 9/2009 | O'Brien | |
| 2010/0077752 | A1 | 4/2010 | Papile | |
| 2010/0146970 | A1 | 6/2010 | Macadam et al. | |
| 2010/0230097 | A1 | 9/2010 | Seaba et al. | |
| 2010/0282644 | A1 | 11/2010 | O'Connor et al. | |
| 2011/0030586 | A1 | 2/2011 | Constantz et al. | |
| 2011/0070136 | A1 | 3/2011 | Gal et al. | |
| 2011/0127036 | A1 | 6/2011 | Tilmont et al. | |

OTHER PUBLICATIONS

PCT/US2012/054596 PCT International Search Report (PCT/ISA/210) Dated Nov. 27, 2012.

* cited by examiner

*Primary Examiner* — William P Neuder
(74) *Attorney, Agent, or Firm* — ConocoPhillips Company

(57) ABSTRACT

Methods and systems for enhancing recovery of hydrocarbons below a permafrost layer are provided which use a downhole combustion device to inject a heated fluid into a subterranean formation to enhance hydrocarbon recovery through viscosity reduction. The system is configured to avoid adversely thermally affecting the permafrost, which is highly undesirable. One or more heat exchangers may be used in conjunction with the combustion device to enhance heat transfer of various streams. The heat exchanger(s) mitigate the adverse effects of various streams on the permafrost by lowering the return stream temperatures, which are transported through the wellbore. A carbon dioxide capture system may be provided to recover carbon dioxide from the combustion device exhaust. Certain optional embodiments allow the amount of carbon dioxide introduced into the formation to be independently controlled to further enhance the hydrocarbon recovery.

15 Claims, 1 Drawing Sheet

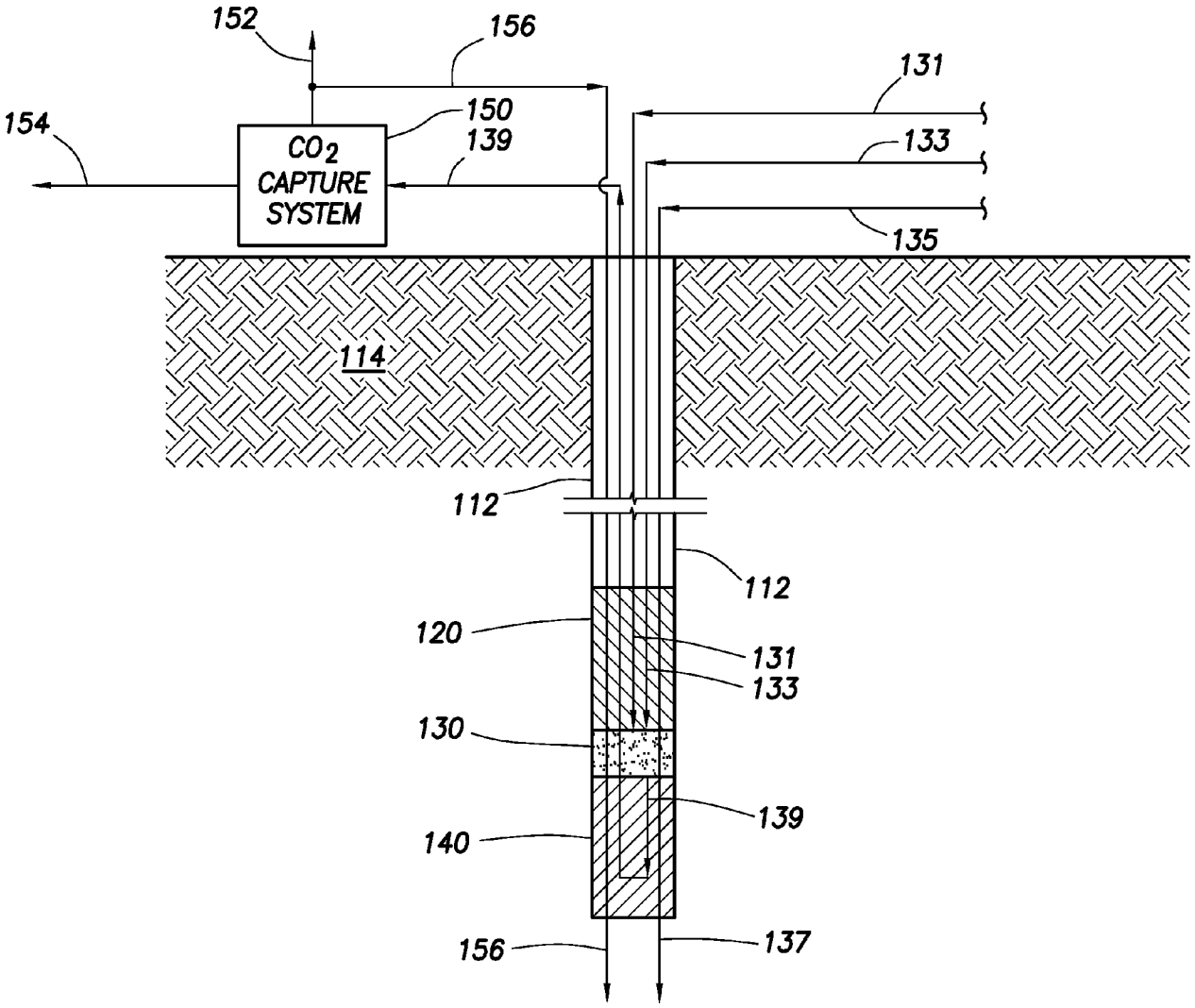
131
133
135
156
150
139
152
154
$CO_2$ CAPTURE SYSTEM
114
112
112
131
133
120
130
139
140
137
156

INDIRECT DOWNHOLE STEAM GENERATOR WITH CARBON DIOXIDE CAPTURE

CROSS-REFERENCE TO RELATED APPLICATIONS

This application is a non-provisional application which claims benefit under 35 USC §119(e) to U.S. Provisional Application Ser. No. 61/533,849 filed 13 Sep. 2011, entitled "INDIRECT DOWNHOLE STEAM GENERATOR WITH CARBON DIOXIDE CAPTURE," which is incorporated herein in its entirety.

FIELD OF THE INVENTION

The present invention relates generally to methods and systems for enhanced recovery of heavy oils. More particularly, but not by way of limitation, embodiments of the present invention include methods and systems using indirect downhole steam generators with carbon dioxide capture systems to enhance recovery of heavy oils.

BACKGROUND

The production of hydrocarbons from low mobility reservoirs presents significant challenges. Low mobility reservoirs are characterized by high viscosity hydrocarbons, low permeability formations, and/or low driving forces. Any of these factors can considerably complicate hydrocarbon recovery. Extraction of high viscosity hydrocarbons is typically difficult due to the relative immobility of the high viscosity hydrocarbons. For example, some heavy crude oils, such as bitumen, are highly viscous and therefore immobile at the initial viscosity of the oil at reservoir temperature and pressure. Indeed, such heavy oils may be quite thick and have a consistency similar to that of peanut butter or heavy tars, making their extraction from reservoirs especially challenging.

Conventional approaches to recovering such heavy oils often focus on methods for lowering the viscosity of the heavy oil so that the heavy oil may be produced from the reservoir, such as heating the reservoir to lower the viscosity of the heavy oil. Commonly used thermal recovery techniques include a number of reservoir heating methods, such as steam flooding, cyclic steam stimulation, and Steam Assisted Gravity Drainage (SAGD).

Further complicating recovery of hydrocarbons from low mobility reservoirs are hydrocarbons situated below a permafrost zone. Permafrost is a layer of earth that is continuously at or below the freezing point of water, usually for two or more years. Conventional thermal heavy oil recovery techniques often suffer from the disadvantage that the heat from such processes heat and thaw the permafrost. Heating the permafrost is generally undesirable due to its adverse environmental impact on the permafrost. Moreover, thawing the permafrost is known to cause ground subsidence, which adversely and undesirably compromises structures built on top of the permafrost. Indeed, thawing the permafrost often causes catastrophic loss of capital equipment as any structures built upon the permafrost will subside into the thawed permafrost. Structures and capital equipment lost in the permafrost often become permanently irretrievable as no practical methods exist for recovering items lost in thawed permafrost.

These energy-intensive thermal recovery conventional methods are also highly disadvantageous in the particularly colder permafrost regions (e.g. especially high or low latitude geographic regions) due to the high heat loss that necessarily occurs in these colder regions. This larger temperature differential contributes to a more inefficient process due to the higher heat losses. Indeed, In some cases, these thermal recovery techniques are so inefficient that they are often not economically viable for recovering heavy crude oil.

To generate the heat required by conventional thermal technologies, these conventional methods typically use combustion devices to produce the required heat. Unfortunately, these combustion devices produce substantial amounts of greenhouse gases, which are often vented to atmosphere. The accumulation of greenhouse gases such as carbon dioxide in the atmosphere is known to contribute to global warming due to the greenhouse effect. Reducing greenhouse gases in the atmosphere remains a continuing global concern. Despite efforts at reducing carbon dioxide emissions, carbon dioxide concentrations in the atmosphere continue to rise annually primarily due to fossil fuel combustion. The United States Environmental Protection Agency (EPA) estimates that the global atmospheric concentrations of carbon dioxide were 35% higher in 2005 than they were before the Industrial Revolution. Accordingly, these energy-intensive conventional methods suffer from excessive greenhouse gas emissions.

One thermal recovery method involves the use of direct steam generators to generate the heat for enhancing the recovery of the heavy oil. Direct steam generators generate steam by directly injecting water along with the fuel and oxidant to be combusted to produce a single output stream of steam and exhaust gases combined together. Thus, due to the design of direct steam generators, the steam produced necessarily includes the combustion exhaust gases.

Direct steam generators suffer from the disadvantage that they operate at low to moderate pressure. Because of limited experience with these combustion systems at higher pressures, direct steam generators are typically constrained to operate at both low to moderate steam output pressures. This lower pressure design constraint is disadvantageous from the standpoint that some deeper reservoirs require higher pressure steam, which direct steam generators are unable to provide. Another disadvantage of high pressure direct steam generators is that they require significant compression of the fuel and oxidant streams.

Direct steam generators also suffer from the inability to independently control the amount of exhaust gas components that are combined with the steam. Due to the design of direct steam generators, any steam produced will necessarily include all of the exhaust gases combined with the steam. This forced combination of other gases with the steam may be disadvantageous where it is desired to inject steam into a subterranean formation without one or more components of the exhaust gas.

Where air is used as the oxidant to the direct steam generator, the exhaust gas will necessarily contain significant amounts of nitrogen. The inability to feasibly separate the exhaust gas from the steam is also particularly problematic in nitrogen-laden steam where reservoirs are negatively impacted by nitrogen.

Accordingly, there is a need for enhanced heavy oil recovery methods that address one or more of the disadvantages of the prior art.

SUMMARY

The present invention relates generally to methods and systems for enhanced recovery of heavy oils. More particularly, but not by way of limitation, embodiments of the present invention include methods and systems using indirect downhole steam generators with carbon dioxide capture systems to enhance recovery of heavy oils.

One example of a method for enhancing heavy oil recovery from a subterranean formation comprises the steps of: providing a first heat exchanger; providing a combustion device; providing a second heat exchanger; situating the first heat exchanger, the combustion device, and the second heat exchanger downhole in a wellbore in the subterranean formation at a depth below a permafrost zone wherein the depth is a sufficient distance from the permafrost zone to avoid substantially thermally affecting the permafrost zone; introducing water, a fuel, and an oxidant downhole to the combustion device; combusting the fuel with the oxidant in the combustion device to form an exhaust gas, the exhaust gas comprising carbon dioxide; introducing the exhaust gas and the water into the second heat exchanger; allowing the exhaust gas to heat the water in the second heat exchanger to form steam; allowing the exhaust gas to exit the second heat exchanger and to be introduced into the first heat exchanger; allowing the water, the fuel, and the oxidant to enter the first heat exchanger and allowing the water, the fuel, and the oxidant to be preheated by the exhaust gas in the first heat exchanger before the step of combusting the fuel with the oxidant in the combustion device; allowing the steam to exit the second heat exchanger into the subterranean formation to heat any in-situ heavy oil to form heated heavy oil; recovering the heated heavy oil from the subterranean formation; recovering the exhaust gas from the first exchanger to the surface and introducing the exhaust gas into a carbon dioxide capture system; and separating a substantial portion of the carbon dioxide from the exhaust gas in the carbon dioxide capture system to form an enriched carbon dioxide stream and a $CO_2$-depleted stream.

One example of a method for enhancing heavy oil recovery from a subterranean formation comprises the steps of: (a) introducing a fluid, a fuel, and an oxidant to a combustion device wherein the combustion device is situated downhole in a wellbore in the subterranean formation below a permafrost zone; (b) combusting the fuel with the oxidant in the combustion device to an exhaust gas, wherein the exhaust gas comprises carbon dioxide; (c) allowing the exhaust gas from the combustion device to heat the fluid in a second stage heat exchange to form a heated fluid; (d) introducing the heated fluid into the subterranean formation; (e) allowing the exhaust gas to exit the second stage heat exchange and to be introduced into a first stage heat exchange; (f) introducing the fluid, the fuel, and the oxidant into the first stage heat exchange and allowing one of the water, the fuel, and the oxidant to be preheated in the first stage heat exchange by the exhaust gas before step (b); (g) recovering the heated heavy oil from the subterranean formation; (h) recovering the exhaust gas from the first stage heat exchange to the surface and introducing the exhaust gas into a carbon dioxide capture system to recover a portion of the carbon dioxide from the exhaust gas to form an enriched carbon dioxide stream and a $CO_2$-depleted stream; and (i) wherein the method is performed at a sufficient distance from the permafrost zone to avoid substantially heating the permafrost zone.

One example of a method for enhancing heavy oil recovery from a subterranean formation comprises the steps of: (a) introducing a fluid, a fuel, and an oxidant to a combustion device wherein the combustion device is situated downhole in the subterranean formation below a permafrost zone; (b) combusting the fuel with the oxidant in the combustion device to an exhaust gas, wherein the exhaust gas comprises carbon dioxide; (c) allowing the exhaust gas from the combustion device to heat the fluid in a second stage heat exchange to form a heated fluid; (d) introducing the heated fluid into the subterranean formation; (e) recovering the heated heavy oil from the subterranean; (f) recovering the exhaust gas from second stage heat exchange to the surface and introducing the exhaust gas into a carbon dioxide capture system to recover a portion of the carbon dioxide from the exhaust gas to form an enriched carbon dioxide stream and a $CO_2$-depleted stream; and (g) wherein the method is performed at a sufficient distance from the permafrost zone to avoid substantially heating the permafrost zone.

One example of a system for enhanced heavy oil recovery in a subterranean formation below a permafrost comprises: a downhole indirect steam generator for combusting a fuel and an oxidant to form an exhaust gas and steam; wherein the downhole combustion device is adapted to be installed downhole in a wellbore; a carbon dioxide capture system adapted to recover carbon dioxide from the exhaust gas; and wherein the system is adapted to avoid substantially heating the permafrost.

The features and advantages of the present invention will be apparent to those skilled in the art. While numerous changes may be made by those skilled in the art, such changes are within the spirit of the invention.

BRIEF DESCRIPTION OF THE DRAWINGS

A more complete understanding of the present disclosure and advantages thereof may be acquired by referring to the following description taken in conjunction with the accompanying figures, wherein:

FIG. 1 illustrates an example of an enhanced heavy oils recovery system in accordance with one embodiment of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

The present invention relates generally to methods and systems for enhanced recovery of heavy oils. More particularly, but not by way of limitation, embodiments of the present invention include methods and systems using indirect downhole steam generators with carbon dioxide capture systems to enhance recovery of heavy oils.

In certain embodiments, methods and systems for enhancing recovery of heavy oils comprise the steps of using a combustion device to produce a heated fluid for injection into a subterranean formation situated below a permafrost layer. The heated fluid lowers the viscosity of the in-situ hydrocarbons and thus enhances recovery of the heavy oils therein. The various system components are located at a sufficient depth to avoid adversely affecting the permafrost. One or more heat exchangers may be used in conjunction with the combustion device to economize or further enhance heat transfer of the various streams that will be described further below. The heat exchanger(s), by economizing heat transfer among the various streams, also mitigate the adverse effects of various streams on the permafrost by lowering the temperature of the return streams, which are transported through the wellbore.

Additionally, certain embodiments include systems for recovery of carbon dioxide from the exhaust gas of the combustion device for sequestration or other applications. Certain optional embodiments also include the ability to independently vary the amount of carbon dioxide introduced into the subterranean formation to supplement the enhancement effects of the injected heated fluid.

Advantages of certain embodiments of enhanced heavy oil recovery methods and systems as compared to various conventional approaches include, but are not limited to, one or more of the following: reduced impact to the permafrost, avoidance of inefficient heat losses during transport of fluids downhole, the ability to independently vary the amount of carbon dioxide injected into a subterranean formation when desired, reduced greenhouse gas emissions, avoidance of nitrogen being introduced into the reservoir where air-fired direct steam generators are used, higher efficiencies due in part to higher pressure steam and/or carbon dioxide introduced into the formation and other advantages that will be apparent from the disclosure herein.

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the invention.

FIG. 1 illustrates an example of an enhanced heavy oil recovery system in accordance with one embodiment of the present invention. In this example, heavy oil recovery system 100 comprises first heat exchanger 120, indirect combustion device 130, second heat exchanger 140, and carbon dioxide capture system 150.

Indirect combustion device 130 is situated in wellbore 112 in subterranean formation 105. Indirect combustion device 130 is sufficiently distant from permafrost 114 to avoid adversely thermally affecting permafrost 114. Additionally, by placing indirect combustion device 130 downhole, the traditional wellbore heat losses that occur during the transport of heated streams to and from the surface are avoided. Moreover, as will be further explained below, the arrangement of first heat exchanger 120 and second heat exchanger 140 with indirect downhole steam generator 130 acts to economize heat and reduce the temperature of streams transported to the surface to minimize heat losses to permafrost 114. Not only does the arrangement of components minimize thermal effects to permafrost 114, optimized arrangements of certain embodiments increase process efficiency by reducing heat loss to the environment.

Fuel 131, oxidant 133, fluid 135 are transported from the surface to indirect combustion device 130. Fuel 131 combusts with oxidant 133 for indirectly heating fluid 135 to form heated fluid 137. In certain embodiments, fluid 131 comprises water, and heated fluid 137 comprises steam, hot water, or any combination thereof. Fluid 131 may comprise any fluid which when heated and introduced into subterranean formation 105 is suitable for heating the in-situ heavy oil without adversely affecting the heavy oil therein. Examples of suitable fluids for heating in indirect combustion device include, but are not limited to, water, aliphatic hydrocarbons having 4 carbons to 30 carbons, light non-condensable hydrocarbon solvents having 1 to 4 carbons, naptha, syncrude, diesel, aromatic solvents, toluene, benzene, xylene, hexane, or any combination thereof. Upon heating fluid 131 to form heated fluid 137, heated fluid 137 may be present in a liquid state, a gaseous state, or a two-phase state depending on the amount of heat transferred to fluid 131.

The combustion of fuel 131 with oxidant 133 forms exhaust gas 139. Exhaust gas 139 then passes through second heat exchanger 140. Second heat exchanger 140 allows exhaust gas 139 to heat fluid 135 (e.g. water) to form heated fluid 137 (e.g. steam). Heated fluid 137 then exits heat exchanger 140 and is introduced into subterranean formation 105. Heated fluid 137 then heats the heavy oils in the subterranean formation, which in turn lowers the viscosity of the heavy oils increasing their mobility and enhancing their recovery. In certain embodiments, heated fluid 137 comprises one or more components, which when combined with the heavy oil, lowers the viscosity of the heavy oils easing their recovery. As used herein, the term, "heavy oil" may include any heavy hydrocarbons having greater than 10 carbon atoms per molecule. Further, the heavy hydrocarbons of the hydrocarbon formation can be a heavy oil having a viscosity in the range of from about 100 to about 10,000 centipoise, and an API gravity less than or equal to about 22° API; or can be a bitumen having a viscosity greater than about 10,000 centipoise, and an API gravity less than or equal to about 22° API.

Exhaust gas 139, after exiting the second heat exchanger, is then introduced into first heat exchanger 120. Hot exhaust gas 139 transfers heat to one or more of fuel 131, oxidant 133, and fluid 135 to preheat one or more of these streams before these streams enter combustion device 130. In this way, first heat exchanger 120 is somewhat analogous to an economizer in a traditional boiler. Preheating one or more of fuel 131, oxidant 133, and fluid 135 also allow exhaust gas 139 to be cooled, which has the beneficial effect of reducing any thermal effect of exhaust gas 139 on permafrost 114. It is recognized that first heat exchanger 120 is optional and not required in certain embodiments of the present invention.

Combustion device 130 may be any combustion device suitable for combusting fuel 131 with oxidant 133. In certain embodiments, combustion device comprises a catalytic combustor, which allows combustion device 130 to operate at much lower temperatures.

Fuel 131 may comprise any fuel suitable for combustion with oxidant 133 in combustion device 130 to heat fluid 135. Examples of suitable fuels include natural gas, liquid natural gas condensate, any hydrocarbon, or any combination thereof.

In certain embodiments, one or more of first heat exchanger 120, combustion device 130, and second heat exchanger 140 are combined into one integral unit. In some embodiments, combustion device 130 and second heat exchanger 140 are combined to form an indirect heater (e.g. an indirect steam generator). In yet further embodiments, first exchanger 120 may be combined with the indirect heater to form an economizer integrated with the indirect heater. In some embodiments, first heat exchanger 120 and/or second heat exchanger 140 may function as a first and/or second stage heat exchange as part of an integrated device.

Unlike direct steam generators, the fluid to be heated (e.g. water), is not fed directly into combustion device 130 to be combined with fuel 131 and oxidant 133. Thus, the fluid to be heated, in this case fluid 131, does not combine with exhaust gas 139. Instead, exhaust gas 139, which is formed as the combustion products of fuel 131 and oxidant 133 remains segregated from heated fluid 137. Accordingly, heated fluid 137 does not necessarily contain any exhaust gas 139. This exclusion of exhaust gas 139 from heated fluid 137 is beneficial in those reservoirs that would be negatively impacted by the inclusion of exhaust gases 139. This benefit is particularly significant where oxidant 133 comprises air since in this case, exhaust gases 139 would comprise significant quantities of nitrogen, which often negatively impacts reservoirs. In those situations where it is desired to introduce exhaust gases 139 into the formation, excluding exhaust gases 139 from heated fluid 137 allows one the amount of exhaust gas 139 introduced into formation 105 to be independently controlled.

As described in the Background Section, combustion devices like direct steam generators typically operate at relatively low pressures (e.g. 150-300 psig). Direct steam generators are generally not designed to operate where high pressure steam is desired for deeper reservoirs. Unlike direct steam generators, indirect steam generators are more easily designed to output higher pressure steam (e.g. about 1,500 to about 2,000 psig), which is useful in higher depth reservoirs. Accordingly, by avoiding a direct combustion design, the instant invention is advantageous in certain embodiments in that high pressure steam (e.g. about 1,500 to about 2,000 psig) is possible without all of the design and operational problems that would be inherent with a high pressure direct steam generator.

Exhaust gas 139 necessarily comprises carbon dioxide as a combustion product of fuel 131 and oxidant 135. Where it is desired to recover all or a portion of carbon dioxide from exhaust gas 139, exhaust gas 139 may be introduced into a carbon dioxide capture system 150. Carbon dioxide capture system 152 may comprise any system suitable for separating carbon dioxide from exhaust gas 139. Examples of suitable carbon dioxide capture systems include, but are not limited to, amine-based carbon dioxide scrubbing processes, chilled ammonia processes, hybrid cryogenic approaches, the Benfield process, the Catacarb or hot potassium carbonate process, and other carbon dioxide scrubbing solvents.

Carbon dioxide capture system 150 may benefit from exhaust gas 139 being introduced into carbon dioxide capture system 150 at higher pressures. Where carbon dioxide capture system 150 benefits from a higher pressure exhaust gas 139, combustion device 152 may be fired at higher pressures to produce exhaust gas 139 at elevated pressures (e.g. about 100 to about 400 psig). Exhaust gas 139 is ultimately separated into a $CO_2$-depleted stream 154 and a $CO_2$-enriched stream 152. $CO_2$-enriched stream 152 is formed by removing all or a portion of non-$CO_2$ components from exhaust gas 139. In certain embodiments, $CO_2$-enriched stream 152 may be substantially all carbon dioxide, having less than about 1 percent non-$CO_2$ components, depending on the type of carbon dioxide capture system 150 used In all embodiments, $CO_2$-depleted stream 154 will be vented to atmosphere. $CO_2$-enriched stream 152 may be stored for later use, transported to another useful application, or otherwise sequestered. Recovering carbon dioxide with carbon dioxide capture system 150 is environmentally beneficial in that it reduces greenhouse gas emissions.

In certain embodiments, where it would be beneficial to introduce some carbon dioxide into subterranean formation 105 to enhance recovery of the heavy oil therein, all or a portion of $CO_2$-enriched stream 152 may optionally be introduced into wellbore 112 for injection into subterranean formation 105. If desired, $CO_2$-enriched stream 152 may be preheated in first heat exchanger 120 by heat from exhaust gas 139. If desired, $CO_2$-enriched stream 152 may be heated in second heat exchanger 140 by heat from exhaust gas 139. Introducing $CO_2$-enriched stream 152 into subterranean formation 105 may provide superior recovery enhancement as compared to simply introducing exhaust gases 139 directly into subterranean formation 105. Carbon dioxide may provide viscosity-reducing benefits thereby enhancing recovery of the heavy oil.

It is recognized that any of the elements and features of each of the devices described herein are capable of use with any of the other devices described herein without limitation. Furthermore, it is recognized that the steps of the methods herein may be performed in any order except unless explicitly stated otherwise or inherently required otherwise by the particular method.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations and equivalents are considered within the scope and spirit of the present invention. Also, the terms in the claims have their plain, ordinary meaning unless otherwise explicitly and clearly defined by the patentee.

What is claimed is:

1. A method for enhancing heavy oil recovery from a subterranean formation comprising the steps of:

providing a first heat exchanger;

providing a combustion device;

providing a second heat exchanger;

situating the first heat exchanger, the combustion device, and the second heat exchanger downhole in a wellbore in the subterranean formation at a depth below a permafrost zone wherein the depth is a sufficient distance from the permafrost zone to avoid substantially thermally affecting the permafrost zone;

introducing water, a fuel, and an oxidant downhole to the combustion device;

combusting the fuel with the oxidant in the combustion device to form an exhaust gas, the exhaust gas comprising carbon dioxide;

introducing the exhaust gas and the water into the second heat exchanger;

allowing the exhaust gas to heat the water in the second heat exchanger to form steam;

allowing the exhaust gas to exit the second heat exchanger and to be introduced into the first heat exchanger;

allowing additional quantities of the water, the fuel, and the oxidant to enter the first heat exchanger and allowing the additional quantities of the water, the fuel, and the oxidant to be preheated by the exhaust gas in the first heat exchanger;

allowing the steam to exit the second heat exchanger into the subterranean formation to heat any in-situ heavy oil to form heated heavy oil;

recovering the heated heavy oil from the subterranean formation;

recovering the exhaust gas from the first exchanger to the surface without the exhaust gas being introduced into the subterranean formation and introducing the exhaust gas into a carbon dioxide capture system;

separating a substantial portion of the carbon dioxide from the exhaust gas in the carbon dioxide capture system to form an enriched carbon dioxide stream and a $CO_2$-depleted stream; and introducing a portion of the enriched carbon dioxide stream into the subterranean formation.

2. The method of claim 1 wherein the combustion device and the second heat exchanger are integral and form an indirect downhole steam generator.

3. The method of claim 1 wherein the oxidant comprises air.

4. The method of claim 1 wherein the oxidant is oxygen and wherein the exhaust gas comprises substantially no nitrogen.

5. The method of claim 2 wherein no portion of the exhaust gas is combined with the steam formed in the indirect downhole steam generator prior to recovery of the exhaust gas to the surface.

6. The method of claim 2 further comprising the step of sequestering a portion of the enriched carbon dioxide stream.

7. The method of claim 5 further comprising the step of sequestering a portion of the enriched carbon dioxide stream.

8. The method of claim 1 further comprising the step of heating the enriched carbon dioxide stream in the first heat exchanger.

9. The method of claim 8 further comprising the step of heating the enriched carbon dioxide stream in the second heat exchanger.

10. The method of claim 1 wherein the carbon dioxide capture system is an amine-based carbon dioxide scrubbing process, a chilled ammonia process, a hybrid cryogenic process, a hot potassium carbonate process, or any combination thereof.

11. A method for enhancing heavy oil recovery from a subterranean formation comprising the steps of:

(a) introducing a fluid, a fuel, and an oxidant to a combustion device wherein the combustion device is situated downhole in a wellbore in the subterranean formation below a permafrost zone;

(b) combusting the fuel with the oxidant in the combustion device to an exhaust gas, wherein the exhaust gas comprises carbon dioxide;

(c) allowing the exhaust gas from the combustion device to heat the fluid in a second stage heat exchange to form a heated fluid;

(d) introducing the heated fluid into the subterranean formation;

(e) allowing the exhaust gas to exit the second stage heat exchange and to be introduced into a first stage heat exchange;

(f) introducing additional quantities of the fluid, the fuel, and the oxidant into the first stage heat exchange and allowing one of the additional quantities of the water, the fuel, and the oxidant to be preheated in the first stage heat exchange by the exhaust gas;

(g) recovering the heated heavy oil from the subterranean formation;

(h) recovering the exhaust gas from the first stage heat exchange to the surface without the exhaust gas being introduced into the subterranean formation and introducing the exhaust gas into a carbon dioxide capture system to recover a portion of the carbon dioxide from the exhaust gas to form an enriched carbon dioxide stream and a $CO_2$-depleted stream; and (i) wherein the method is performed at a sufficient distance from the permafrost zone to avoid substantially heating the permafrost zone; and (j) introducing the enriched carbon dioxide stream into the subterranean formation.

12. The method of claim 11 wherein the fluid comprises a liquid and wherein the heated fluid comprises a gas, wherein the first stage heat exchange is a first heat exchanger, wherein the second stage heat exchange is a second heat exchanger.

13. The method of claim 12 wherein the first stage heat exchange and the second stage heat exchange occur in a single integral heat exchanger unit.

14. A method for enhancing heavy oil recovery from a subterranean formation comprising the steps of:

(a) introducing a fluid, a fuel, and an oxidant to a combustion device wherein the combustion device is situated downhole in the subterranean formation below a permafrost zone;

(b) combusting the fuel with the oxidant in the combustion device to an exhaust gas, wherein the exhaust gas comprises carbon dioxide;

(c) allowing the exhaust gas from the combustion device to heat the fluid in a heat exchange to form a heated fluid;

(d) introducing the heated fluid into the subterranean formation;

(e) recovering the heated heavy oil from the subterranean formation;

(f) recovering the exhaust gas from heat exchange to the surface without the exhaust gas being introduced into the subterranean formation and introducing the exhaust gas into a carbon dioxide capture system to recover a portion of the carbon dioxide from the exhaust gas to form an enriched carbon dioxide stream and a $CO_2$-depleted stream; and (g) wherein the method is performed at a sufficient distance from the permafrost zone to avoid substantially heating the permafrost zone; and (h) introducing the enriched carbon dioxide stream into the subterranean formation.

15. A system for enhanced heavy oil recovery in a subterranean formation below a permafrost comprising:

a downhole indirect steam generator for combusting a fuel and an oxidant to form an exhaust gas and steam;

wherein the downhole combustion device is adapted to be installed downhole in a wellbore;

a carbon dioxide capture system adapted to recover the exhaust gas on surface and provide an enriched carbon dioxide stream from the exhaust gas without the exhaust gas being introduced into the subterranean formation;

a conduit from the carbon dioxide capture system into the wellbore for introducing the enriched carbon dioxide stream into the subterranean formation; and wherein the system is adapted to avoid substantially heating the permafrost.

* * * * *